United States Patent [19]

Ueda et al.

[11] Patent Number: 4,494,998

[45] Date of Patent: Jan. 22, 1985

[54] PROCESS FOR PRODUCING AUSTENITIC STAINLESS STEELS LESS SUSCEPTIBLE TO ROLLING DEFECTS

[75] Inventors: Masanori Ueda; Ryousuke Takahashi, both of Fukuoka; Hidemaro Takeuchi, Yamaguchi, all of Japan

[73] Assignee: Nippon Steel Corporation, Tokyo, Japan

[21] Appl. No.: 411,953

[22] Filed: Aug. 26, 1982

Related U.S. Application Data

[63] Continuation-in-part of Ser. No. 341,629, Jan. 22, 1982, abandoned.

[30] Foreign Application Priority Data

Jan. 31, 1981 [JP] Japan ..... 56-13696
Jan. 31, 1981 [JP] Japan ..... 56-13697

[51] Int. Cl.[3] ..... C22C 38/12

[52] U.S. Cl. ..... 148/2; 164/476; 164/76.1

[58] Field of Search ..... 148/2; 164/476, 76.1; 29/52.77

[56] References Cited

U.S. PATENT DOCUMENTS 4,092,178 5/1978 Onoe et al. ..... 148/2
4,325,748 4/1982 Nashiwa et al. ..... 148/2

FOREIGN PATENT DOCUMENTS 123325 4/1977 Japan ..... 148/2

*Primary Examiner*—L. Dewayne Rutledge
*Assistant Examiner*—Debbie Yee
*Attorney, Agent, or Firm*—Cushman, Darby & Cushman

[57] ABSTRACT

Process for producing austenitic stainless steels, which process prevents occurrence of rolling defects, particularly slivers. Specifically, process for controlling casting conditions on the basis of nitrogen contents in the molten steel and further controlling hot working conditions including heating conditions and working temperature.

6 Claims, 2 Drawing Figures

PROCESS FOR PRODUCING AUSTENITIC STAINLESS STEELS LESS SUSCEPTIBLE TO ROLLING DEFECTS

CROSS REFERENCE TO RELATED APPLICATION

This application is a continuation-in-part of our copending application Ser. No. 341,629 filed Jan. 22, 1982, and now abandoned.

BACKGROUND OF THE INVENTION

1. Field of the Invention

The present invention relates to a process for producing austenitic stainless steels which process prevents occurrence of rolling defects, particularly slivers.

2. Description of Prior Arts

It has been conventionally known that austenitic-alloys such as austenitic stainless steels show inferior hot workabilities during break-down rolling of ingots, for example, thus susceptible to cracks, and higher alloy steels are more difficult to work from a large steel ingot. Up-to-now, various studies have been made for overcoming these difficulties, and effective means for preventing cracks even in the case of high alloy steels have been made and it is now very seldom that the high alloy steels cannot be satisfactorily produced due to occurrence of large cracks, but they are still susceptible to small cracks.

Meanwhile, as continuous casting technics have been adopted more and more, similar problems have been found in hot workability of continuously cast slabs into thick plates and these plates are often susceptible to occurrence of small crack defects, particularly slivers as will be described hereinafter.

Therefore, separate from the problem of large cracks which prohibit commercial production of the steel plates, there are problems to be solved that when a solidified steel structure, such as a continuous cast steel slab and a steel ingot, is hot rolled and acid-pickled, fine cracks normally called slivers occur locally to a very shallow depth on the surface of the steel after acid-pickling. These slivers naturally lower the production yield of the steel plates, and require a re-conditioning step, and in the worst case resultant products fail to meet ordered size specifications, thus being rejected.

The present inventors have made investigations for determining causes for these fine defects and slivers (hereinafter called "slivers"), and have found that these slivers are to be a kind of hot working crack due to inferior hot workability. Although these slivers do not cause a vital problem which prohibits commercial production with respect to the hot workability, these cracks must be considered to be a practically great problem, because these cracks are found in steel grades, such as SUS (Japanese Industrial Standard) 304, SUS 316 and SUS 347 stainless steels which are normally produced on a mass-production scale. Therefore the present inventors have investigated on possible causes of the cracks and studied on possibility of quantitative means for effectively and economically preventing the cracks.

For example, when a continuously cast slab of SUS 316 grade is ground 2 mm on the whole surfaces, heated to 1200° C. or higher and rolled, slivers in the worst case occur all over the surfaces of the acid-pickled steel sheets, chiefly on the edge sides of about 150 mm in width, and reach 2 to 5 mm depth max. condensing in a great number. In order to obtain satisfactory final products, these defect portions must be totally ground. These slivers sometimes occur also in hot coils.

The present inventors have made detailed investigations on these phenomena so as to determine the nature of slivers and their causes for different steel grades and different production processes, and found the following facts:

(1) Slivers are caused due to the lowering of deformation ability of the steel during hot working, and occur around the $\gamma$ grains during soldification.

(2) The occurrence of slivers is greatly influenced by production conditions, such as casting conditions and hot rolling conditions.

(3) Mainly sulfides segregate at the $\gamma$ grain boundaries, and cracks develop along these sulfides.

Therefore, preventive means are desired for preventing the sulfides from precipitating at the $\gamma$ grain boundaries, and for this purpose it is necessary to maintain the contents of impurities, such as sulfur, below their permissible limits. Thus the sulfur content should be maintained not larger than 0.005% and oxygen not larger than 0.006%.

Further, at the time of solidification of the steel, it is desirable to disperse the impurities, such as sulfur and oxygen, and utilize the proeutetic delta ferrite as an effective means for preventing the precipitation of the impurities at the grain boundaries, and for this purpose the "δcal(%)" index representing the amount of the delta ferrite after the solidification of the steel should be desirably between −3 and 4.

$$\delta cal(\%)=3(Cr+Mo+1.5\,Si+0.5\,Nb)-2.8(Ni+\tfrac{1}{2}Mn+\tfrac{1}{2}Mn+\tfrac{1}{2}Cu)-84(C+N)-19.8.$$

The results of our investigation on the relation between the occurrence and the continuous casting conditions as well as the hot rolling conditions have revealed that the casting temperature control with respect to the continuous casting and the heating temperature control with respect to the hot rolling are very important for completely eliminating the occurrence of slivers. Thus, suppose the nitrogen content in the alloy is N(%) by weight, and the casting temperature is expressed as the difference ΔT(°C.) between the molten metal temperature T in the tundish (tundish temperature) and the melting point $T_L$ of the alloy steel, and the tundish temperature is controlled under the condition of $N\times\Delta T\leqq 1.5$. Continuously cast steel slabs obtained under this condition have been found to have very little susceptibility to the occurrence of slivers during the subsequent hot rolling.

Further, the present inventors have found it is very effective for preventing the occurrence of slivers to control the heating temperature $H_T$ for hot rolling under the condition of $H_T(°C.)\leqq 1325(°C.)-50\times[N\times\Delta T]$.

SUMMARY OF THE INVENTION

The present invention provides a process for producing an austenitic stainless steel less susceptible to occurrence of rolling defects, which comprises continuously casting an austenitic stainless steel melt containing not less than 0.005% N under the condition of $N\times\Delta T\leqq 1.5$, in which N represents the percentage of the nitrogen content, ΔT represents the difference between the tundish temperature and the melting point of the stainless steel and ranges from 10° C. to 50° C. and, a process for producing an austenitic stainless steel less susceptible to occurrence of rolling defects, which comprises continuous casting an austenitic stainless steel melt and heating the steel slab thus obtained for hot rolling under the condition of $$H_T(°C.) \leqq 1325(°C.) - 50 \times [N \times \Delta T]$$

in which $H_T$(°C.) represents the heating temperature within a range from 1130° C. to 1320° C., N represents percentage of the nitrogen content in the stainless steel and ΔT represents the difference between the tundish temperature and the melting point of the stainless steel.

DETAILED DESCRIPTION OF THE INVENTION

The present invention will be described in detail with reference to the attached drawings.

As described hereinbefore, the present inventors have investigated casting conditions and repeated various tests to determine the interrelation between the casting conditions and the steel composition and have found that the hot workability is greatly influenced by the relation between the nitrogen content and the casting temperature (tundish temperature) among the continuous casting conditions.

In short, the present inventors have found that the occurrence of defects due to hot working can be prevented by controlling the casting temperature on the basis of the nitrogen contents in the molten steel. In order to confirm this discovery, the following experiment was made.

Various SUS 316 stainless steel heats were prepared within the following composition range:

C≈0.02–0.06%
Si≈0.5%
Mn≈1.1%
P≈0.023%
S≈0.002%
Cr≈17.1%
Ni≈11.5–12.5%
Mo≈2.1%
Cu≈0.2%
N≈0.01–0.08%
O≈0.0035%
balance=Fe and unavoidable impurities.

Figure 1:
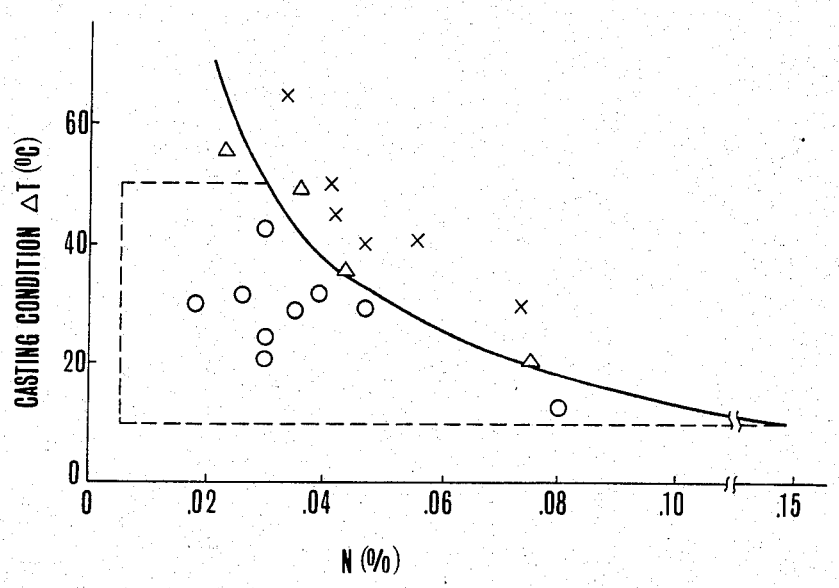
FIG. 1 shows the relation between the occurrence of slivers due to hot rolling and the nitrogen content N(%) and the casting condition ΔT(°C.). (Specimen: continuously cast SUS 316 stainless steel slab).

These molten steels were cast at various temperatures, and as conventionally, surface ground all over, heated to 1250° C., rolled to obtain thick plates, which were subjected to investigation of slivers. Generally the casting condition is specified by the difference ΔT(°C.) between the melting point $T_L$ of the molten alloy steel being cast and the casting temperature T. The correlation between the melting point $T_L$ of an alloy and the alloy composition is determined by the following formula:

$$T_L = K - F(\%C) - (13.0 \times \%Si + 4.8 \times \%Mn + 1.5 \times \%Cr + 4.3 \times \%Ni + 3 \times \%Mo)$$

in which $K - F(\%C) = 1538 - 55 \times \%C - 80 \times \%C^2$. In FIG. 1, the occurrence of slivers in SUS 316 stainless steel thick plates (8–20 mm thick) prepared by hot rolling a continuously cast slab (130–160 mm thick) is shown by the relation with the casting condition ΔT and the nitrogen content N in the molten steel. The heating temperature for the hot rolling is 1250° C. and δcal is −3(%)~3(%). The solid line connecting the mark o representing freedom from occurrence of slivers can be expressed by $N \times \Delta T \leqq 1.5$. Meanwhile, the mark x represents remarkable occurrence of slivers and the mark Δ represents some tolerable occurrence of slivers. As understood from the graph, if the nitrogen content N in the steel is increased, the casting must be done at lower temperatures by lowering the tundish temperature, thus reducing the difference ΔT. Otherwise, slivers and other rolling defects have an increased tendency to occur during the hot rolling. Also if the nitrogen content is not lowered, the rolling defects are more apt to occur during the hot rolling even when the casting is done at an increased tundish temperature.

In this way, it is understood that in order to obtain a steel slab not susceptible to hot rolling defects including slivers, it is essential to perform the casting under the condition of $N \times \Delta T \leqq 1.5$, and that other conditions such as cooling condition and electromagnetic stirring condition are not so significant.

As mentioned hereinbefore, it has been found that the occurrence of slivers during the hot working can be more effectively prevented with less restriction on the nitrogen content N, when the heating temperature of the slab for hot rolling is controlled in addition to the control of the casting temperature on the basis of the nitrogen content N.

The following experiment was conducted to confirm the above discovery.

SUS 316 stainless steel heats with different nitrogen contents ranging from 0.01 to 0.08% were prepared within the following composition range.

C≈0.02–0.06%
Si≈0.5%
Mn≈1.1%
P≈0.023%
S≈0.002%
Cr≈17.1%
Ni≈11.5–12.5%
Mo≈2.1%
Cu≈0.2%
O≈0.0035%
balance=Fe and unavoidable impurities.

These heats were cast at various casting temperatures with different cooling conditions and different electromagnetic stirring conditions. The resultant slabs were surface ground all over, heated to temperatures ranging from 1300° C.–1150° C., hot rolled into thick plates, which were investigated for determining occurrence of slivers.

The relation between the occurrence of slivers during the hot rolling and the nitrogen content in the steel and the casting conditions, particularly the casting temperature condition ΔT is same as shown in FIG. 1, but our further investigations have revealed that, it is very important for preventing the occurrence of rolling defects to control the working temperature or heating condition for the hot rolling depending on the hot workability indices of $N \times \Delta T$ determined by the nitrogen content N(%) in the steel and the casting condition $\Delta T$(°C). The present inventors have confirmed the above points through experiments, results of which are shown in FIG. 2.

In the case of a slab having a small value of $N \times \Delta T$ and having a good hot workability, the heating temperature range may be made wider for the hot working without occurrence of defects, but on the other hand, in the case of a slab having a large value of $N \times \Delta T$ and having an inferior hot workability, the heating temperature for the hot rolling must be made low. As shown in FIG. 2, the allowable heating temperature range $H_T$ is determined by the following formula on the basis of $N \times \Delta T$.

$$H_T(°C.) \leqq 1325(°C.) - 50 \times [N \times \Delta T].$$

Figure 2:
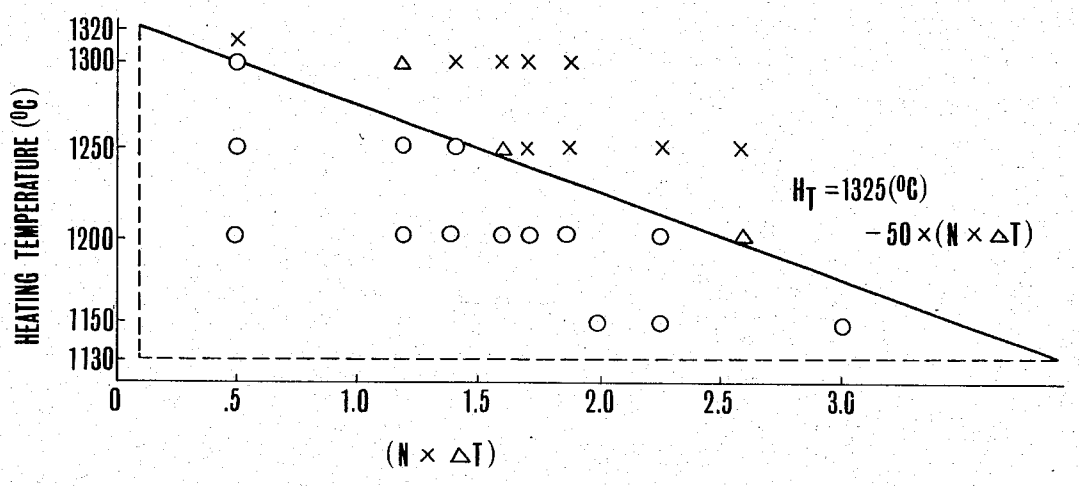
FIG. 2 shows the effects of the nitrogen content N(%), the casting condition ΔT(°C.) and the slab heating temperature $H_T$(°C.) on the occurrence of slivers. (Specimen: continuously cast SUS 316 stainless steel slab).

As shown in FIG. 2, the working temperature has some considerable effect on the occurrence of defects. Thus a lower temperature working is advantageous. The heating temperature can be lowered on the basis of $N \times \Delta T$ and hence the working temperature is made relatively low, thus contributing for prevention of the occurrence of slivers.

In this way, it has been found that if the nitrogen content N(%) in a continuously cast steel slab and the casting temperature condition $\Delta T$(°C.) are known, the allowable heating temperature $H_T$ for hot rolling can be determined on the basis of $N \times \Delta T$, and thereby it is possible to determine the conditions for preventing the occurrence of rolling defects without sacrificing the rolling efficiency.

All of the nitrogen content N(%), the casting temperature condition $\Delta T$(°C.) and the heating temperature $H_T$(°C.) are considered to be related with the $\gamma$ grain size after the casting and during the heating and have influence on the occurrence of cracks at the $\gamma$ grain boundaries during the hot working. Therefore, the principle for prevention of the rolling defects is basically applicable to the reheating process of a continuously cast steel slab and further applicable to the hot-charge process or CC-DR process (continuous casting→direct rolling process).

Next, descriptions, will be made on the austenitic stainless steel compositions to which the present invention is applicable.

Regarding the corrosion resistance, a lower carbon content is more favourable, and the lower limit is set at 0.001%. Regarding the heat resistance, a higher carbon content is more desirable and the upper limit is set at 0.20%.

Silicon should be in an amount not less than 0.1% so as to assure satisfactory deoxidation of the steel, and a higher silicon content is desirable for oxidation resistance, and the upper limit of the silicon content is set at 4%, beyond which the tendency of embrittlement becomes large.

Less than 0.1% manganese is not enough for desired deoxidation of the steel, and a higher manganese content is desirable for the stabilization of austenite. However, beyond 4% of manganese content, no additional effect is obtained, and the upper limit is set at 4%.

Lower phosphorus contents are more desirable, and the upper limit is set at 0.030%. Beyond 0.03% the corrosion resistance is deteriorated.

Sulfur has a large tendency to segregate at the $\gamma$ grain boundaries during the solidification of the steel, and is a principal cause for the occurrence of slivers. Therefore, the sulfur content should be maintained as low as possible, and the upper limit is set at 0.005%. Beyond 0.005% the hot workability is deteriorated even if all other measures are taken.

Oxygen, just as sulfur, promotes the occurrence of slivers and should be maintained as low as possible, and the upper limit is set at 0.006%.

Chromium should be maintained at least 15% for the desired corrosion resistance, but more than 30% chromium causes difficulties in working.

Nickel should be maintained at least 7% for the desired stabilization of the structure as a stainless steel, but the upper limit is set at 28%, beyond which no substantial effect is obtained with only increased production cost.

Molybdenum is effective to increase the acid resistance and pit corrosion resistance, and may be selectively added up to 3% depending on final applications of the steel.

Copper is also effective for acid resistance, and may be selectively added up to 3% in some applications.

Niobium is effective to stabilize carbides and may be selectively added up to 1%, beyond which the tendency of embrittlement becomes apparent.

With respect to the corrosion resistance, selective addition of tin up to 0.1% is desirable, but beyond 0.1% no additional improvement is obtained.

Nitrogen is an effective austenite former, but an excessive addition of nitrogen deteriorates the hot workability of the steel. The lower limit of the nitrogen content depends on the technical accessibility and it is normally difficult to lower the nitrogen content to 0.001% or less.

For preventing the occurrence of slivers, it is desirable to control the main components by δcal as shown below:

$$\delta cal = 3(Cr + Mo + 1.5Si + 0.5Nb) - 2.8(Ni + \tfrac{1}{2}Mn + \tfrac{1}{2}Cu) - 84(C + N) - 19.8.$$

If the value of δcal is a negative value exceeding −3, there is a larger tendency of the occurrence of slivers, but if the value of δcal is a positive value, uniform distribution of sulfur and oxygen can be achieved during the solidification of the steel, but if it exceeds 4 reverse effects are caused.

The stainless steel of the invention furthermore can contain one or more of not over 3% Mo, not over 3% Cu, no more than 1% Nb, no more than 0.1% Sn and one or more of 0.005 to 0.1% Ti, 0.005 to 0.1% Zr and 0.0005 to 0.050% Ca.

In the present invention, when the occurrence of sliver is to be prevented only by controlling the casting condition on the basis of the nitrogen content in the steel, the upper limit of the nitrogen content is determined by $\Delta T$ in the formula of $N \times \Delta T \leqq 1.5$. Further, the factor $\Delta T$ is also limited to the range from 10° C. Beyond 50° C., the surface portion of the resultant cast steel slab is of coarsegrained structure with deteriorated hot workability. Although a smaller $\Delta T$ value is desirable for the hot workability, if it gets smaller than 10°

C., the slab becomes much susceptible to defects due to non-metallic inclusions.

Further, according to the present invention, when not only the casting condition is controlled on the basis of the nitrogen content, but also the heating temperature condition $H_T$ prior to the hot rolling is controlled, the upper limit of $H_T$ is set at 1320° C., beyond which the grain growth becomes so vigorous as to lower the hot workability with increased scale loss. On the other hand, lower limit is set at 1130° C., below which the deformation resistance of the steel becomes larger, requiring increased rolling load thus prohibiting the rolling operation, or remarkably lowering the rolling efficiency.

DESCRIPTION OF PREFERRED EMBODIMENTS

The present invention will be better understood from the following description of the preferred embodiments.

EXAMPLE 1

130 to 190 mm thick steel slabs with different nitrogen contents were cast from austenitic stainless steel melts (SUS 304, SUS 316 and SUS 309) by controlling the casting temperature (ΔT(°C.)). In addition to the control of ΔT(°C.), the cooling condition and the electromagnetic stirring conditions were controlled in a conventionally known way. The slabs thus obtained were ground all over and subjected to thick-plate rolling. The heating condition in the heating furnace was maintained in the range from 1240° C. to 1250° C. as conventionally, and also the rolling was done in a conventional way. After the hot rolling, the obtained steel plates (10–16 mm thick) were subjected to heat treatments and acid-pickling and then investigated for determination of the occurrence of sliver. The results of the investigation are shown in Table 1. The evaluation of the occurrence of slivers was decided by the number of steel plates suffering from so many slivers as to require the surface conditioning, expressed as percentage of the total number (100 min.) of the steel plates. In this way, it is possible to maintain the occurrence of slivers at a very low level by controlling the value of $N \times \Delta T$ to 1.5 or less.

EXAMPLE 2

130 to 190 mm thick steel slabs with different nitrogen contents were cast from austenitic stainless steel melts (SUS 304, SUS 316, SUS 316L and SUS 309) by controlling the casting temperature [ΔT(°C.)]. In addition to the control of ΔT(°C.), the cooling condition and the electromagnetic condition were controlled in a conventionally known way. The steel slabs thus obtained were ground all over the surface and subjected to thick-plate rolling.

Regarding the heating prior to the rolling, the heating temperature in the heating furnace was controlled for individual slabs in the range not exceeding the allowable heating temperature limit of $H_T = 1325(°C.) - 50 \times [\Delta T \times N]$ formulated on the basis of the nitrogen content N(%) and the casting temperature expressed as ΔT(°C.).

The rolling operation was performed under conventional conditions other than the heating condition as above-mentioned. The steel plates (10–16 mm thick) thus obtained were subjected to heat treatments and acid-pickling and then investigated for evaluation of the occurrence of slivers. The evaluation was made in the same way as in Example 1. The results of the investigation are shown in Table 2 and FIG. 2.

As clearly shown, it is possible to maintain the occurrence of slivers at a very low level by hot rolling, the steel slab under the condition of $H_T \leqq 1320(°C.) - 50 \times [\Delta T \times N]$. In FIG. 2, the relation between the occurrence of slivers during the hot rolling of SUS 316 stainless steel slabs (130 to 160 mm thick, $\delta cal(\%) = -3(\%) \sim 3(\%)$) obtained by continuous casting and the nitrogen content N(%) the casting condition ΔT(°C.) and the slab heating temperature $H_T(°C.) = 1325(°C.) - 50 \times (N \times \Delta T)$.

TABLE 1

| Alloy Steels | Main Components (weight %) | N Content (%) | Casting Condition: Slab Thickness (mm) | Casting Condition: ΔT (°C.) | Casting Condition: NxΔT | Occurrence of Slivers due to Thick-plate Rolling (Heating: 1250° C.) |
|---|---|---|---|---|---|---|
| Present Invention | | | | | | |
| SUS 304 | 0.06% C—19Cr—8Ni | 0.032 | 190 | 30 | 0.96 | o |
| " | " | 0.048 | 190 | 28 | 1.34 | o |
| SUS 316 | 0.05% C—17Cr—12Ni—2.2Mo | 0.017 | 130 | 29 | 0.49 | o |
| " | " | 0.025 | 130 | 31 | 0.78 | o |
| " | " | 0.047 | 130 | 28 | 1.30 | o |
| SUS 316L | 0.02% C—17Cr—13Ni—2.2Mo—0.3Cu—0.006Sn | 0.022 | 130 | 44 | 0.88 | o |
| " | " | 0.044 | 130 | 25 | 1.10 | o |
| " | " | 0.083 | 130 | 18 | 1.49 | θ |
| SUS 309 | 0.08% C—22Cr—12Ni | 0.043 | 160 | 33 | 1.42 | o |
| Conventional Process | | | | | | |
| SUS 304 | 0.06% C—19Cr—8Ni | 0.029 | 190 | 55 | 1.59 | x |
| SUS 316 | 0.05% C—17Cr—12Ni—2.2Mo | 0.035 | 160 | 49 | 1.70 | x |
| SUS 316L | 0.02% C—17Cr—13Ni—2.2Mo—0.3Cu | 0.046 | 160 | 50 | 2.30 | x |
| " | " | 0.055 | 160 | 45 | 2.48 | x |

Evaluation of occurrence of slivers expressed in percentage of the number of plates suffering slivers to the total number of rolled plates o: 3% or less θ: 5% or more x: 10% or more

TABLE 2

| Alloy Steels | Main Components (weight %) | N Content (%) | Casting Conditions: Slab Thickness (mm) | Casting Conditions: ΔT (°C.) | NxΔT | Heating Temperature for Hot Rolling & Occurrence of Slivers Thickness of Steel Plates: 10–16 mm: 1280° C. | 1250° C. | 1200° C. | 1150° C. |
|---|---|---|---|---|---|---|---|---|---|
| Present Invention | | | | | | | | | |
| SUS 304 | 0.06% C—19Cr—9Ni | 0.042 | 190 | 32 | 1.34 | / | θ | o | o |
| SUS 316 | 0.05% C—17Cr—12Ni—2.2Mo | 0.021 | 130 | 40 | 0.84 | / | o | o | o |
| " | " | 0.044 | 130 | 30 | 1.32 | / | o | o | o |
| " | " | 0.080 | 130 | 22 | 1.76 | / | / | o | o |
| SUS 316L | 0.02% C—17Cr—13Ni—2.1Mo—0.3Cu—0.006Sn | 0.021 | 130 | 25 | 0.53 | o | o | o | o |
| " | " | 0.052 | 130 | 20 | 1.04 | / | o | o | o |
| " | " | 0.078 | 130 | 38 | 2.96 | / | / | / | o |
| SUS 309 | 0.09% C—21Cr—13Ni | 0.065 | 160 | 38 | 2.47 | / | / | θ | o |
| Conventional Process | | | | | | | | | |
| SUS 304 | 0.06% C—19Cr—9Ni | 0.042 | 190 | 32 | 1.34 | x | / | / | / |
| SUS 316 | 0.05% C—17Cr—12Ni—2.2Mo | 0.080 | 130 | 22 | 1.76 | x | x | / | / |
| SUS 316L | 0.02% C—17Cr—13Ni—2.1Mo—0.3Cu | 0.078 | 130 | 38 | 2.96 | x | x | x | / |
| SUS 309 | 0.09% C—21Cr—13Ni | 0.065 | 160 | 38 | 2.47 | x | x | / | / |

Evaluation of Occurrence of Slivers: Same as in Table 1

What is claimed is:

1. A process for producing austenitic stainless steels less susceptible to rolling defects, comprising:

continuously casting an austenitic stainless steel containing not less than 0.005% nitrogen under the condition of $N \times \Delta T \leqq 1.5$, in which N represents the nitrogen content percentage, and ΔT represents the difference between a tundish temperature of the steel and the melting point of the steel and ranges from 10° C. to 50° C., and hot rolling the steel slab thus obtained.

2. A process according to claim 1, in which the stainless steel contains 0.001 to 0.2% C, 0.1 to 4% Si, 0.1 to 4% Mn, not larger than 0.03% P, not larger than 0.005% S, not larger than 0.006% O, 15 to 30% Cr, 7 to 28% Ni, with the balance being iron and unavoidable impurities, and δcal defined below is between −3 and +4:

$$\delta cal = 3(Cr + Mo + 1.5Si + 0.5Nb) - 2.8(Ni + \tfrac{1}{2}Mn + \tfrac{1}{2}Cu) - 84(C + N) - 19.8.$$

3. A process according to claim 2, in which the stainless steel further contains one or more of not larger than 3% Mo, not larger than 3% Cu, not larger than 1% Nb, not larger than 0.1% Sn, and one or more of 0.005 to 0.1% Ti, 0.005 to 0.1% Zr, and 0.0005 to 0.050% Ca.

4. A process for producing austenitic stainless steels less susceptible to rolling defects, comprising:

continuously casting an austenitic stainless steel containing nitrogen under the condition of $N \times \Delta T$, in which N represents the nitrogen content percentage in the steel and ΔT represents the difference between a tundish temperature of the steel and the melting point of the steel, and heating the slab thus obtained for hot rolling under the condition $$H_T(°C.) \leqq 1325(°C.) - 50 \times [N \times \Delta T]$$

in which $H_T$(°C.) represents the heating temperature ranging from 1130° C. to 1320° C. for the hot rolling.

5. A process according to claim 4, in which the stainless steel contains 0.001 to 0.2% C, 0.1 to 4% Si, 0.1 to 4% Mn, not larger than 0.03% P, not larger than 0.005% S, not larger than 0.006% O, 15 to 30% Cr, 7 to 28% Ni, with the balance being iron and unavoidable impurities, and δcal defined below is between −3 and +4:

$$\delta cal = 3(Cr + Mo + 1.5Si + 0.5Nb) - 2.8(Ni + \tfrac{1}{2}Mn + \tfrac{1}{2}Cu) - 84(C + N) - 19.8.$$

6. A process according to claim 5, in which the stainless steel further contains one or more of not larger than 3% Mo, not larger than 3% Cu, not larger than 1% Nb, not larger than 0.1% Sn.

* * * * *